US007647799B2

(12) United States Patent
Markbreit et al.

(10) Patent No.: US 7,647,799 B2
(45) Date of Patent: Jan. 19, 2010

(54) KEY COMBINATION ELEMENT IN KEY BLANK AND KEY

(75) Inventors: Dani Markbreit, Azur (IL); Effi Ben-Aharon, Petach Tikva (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 289 days.

(21) Appl. No.: 10/593,718

(22) PCT Filed: Mar. 28, 2005

(86) PCT No.: PCT/IL2005/000348

§ 371 (c)(1),
(2), (4) Date: Sep. 21, 2006

(87) PCT Pub. No.: WO2005/095738

PCT Pub. Date: Oct. 13, 2005

(65) Prior Publication Data

US 2008/0236223 A1 Oct. 2, 2008

(30) Foreign Application Priority Data

Mar. 30, 2004 (GB) ..... 0407196.5

(51) Int. Cl.
*E05B 19/06* (2006.01)

(52) U.S. Cl. ..... 70/409; 70/495; 70/408; 70/399

(58) Field of Classification Search ..... 70/408–409, 70/388, 399, 495
See application file for complete search history.

(56) References Cited

U.S. PATENT DOCUMENTS

| | | | | |
|---|---|---|---|---|
| 4,667,495 | A * | 5/1987 | Girard et al. | 70/398 |
| 5,170,651 | A * | 12/1992 | Errani | 70/493 |
| 5,437,176 | A | 8/1995 | Keller | |
| 5,724,841 | A * | 3/1998 | Botteon | 70/493 |
| 6,257,033 | B1 | 7/2001 | Ziv-Av | |
| 6,490,898 | B1 * | 12/2002 | Mottura | 70/495 |
| 6,508,091 | B1 | 1/2003 | Donatini | |
| 6,681,609 | B1 | 1/2004 | Preddey | |

FOREIGN PATENT DOCUMENTS

| | | |
|---|---|---|
| EP | 0416500 | 3/1991 |
| GB | 2161204 | 1/1986 |
| WO | WO 00/57006 | 9/2000 |

OTHER PUBLICATIONS

Decision to Grant Corresponding European Patent Application EP05718921.9.

* cited by examiner

*Primary Examiner*—Peter M Cuomo
*Assistant Examiner*—Kristina R Fulton
(74) *Attorney, Agent, or Firm*—Dekel Patent Ltd.; David Klein

(57) ABSTRACT

A key blank including a generally elongate shaft portion defining first and second generally flat oppositely directed side surfaces, joined by edge surfaces, at least one of the first and second side surfaces cuttable to form key cuts that define a key combination surface, and at least one key combination element movably disposed in the elongate shaft portion and adapted for touching a lock combination element disposed in a cylinder lock plug, wherein the at least one key combination element has inherent energy for applying an urging force against the lock combination element. A key formed from the key blank and lock therefore are also disclosed.

8 Claims, 4 Drawing Sheets

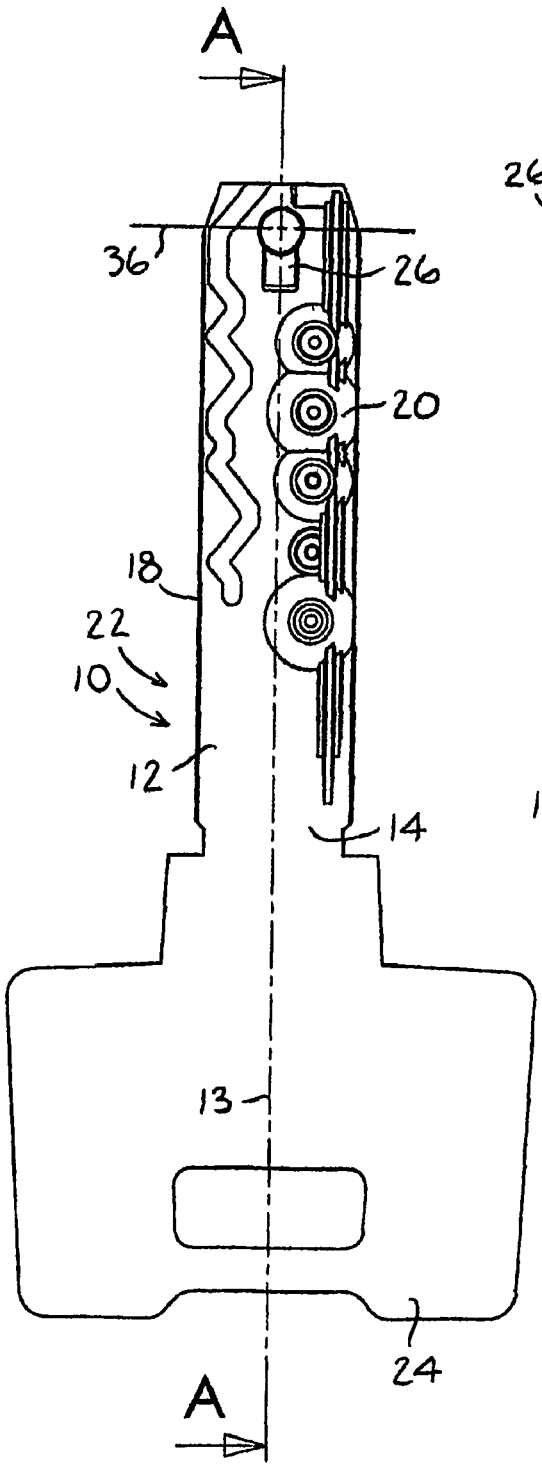
FIG. 1
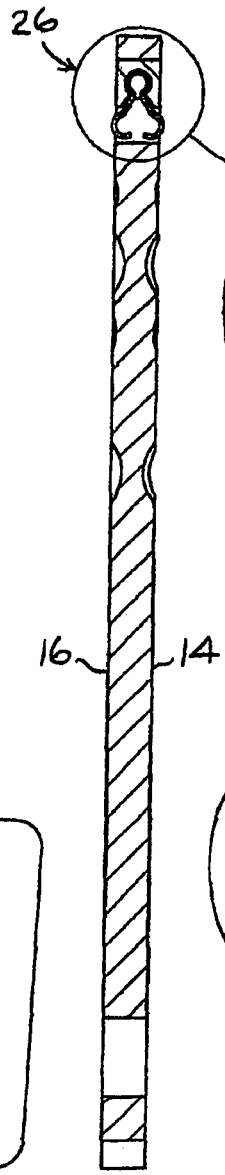
FIG. 2
FIG. 3A
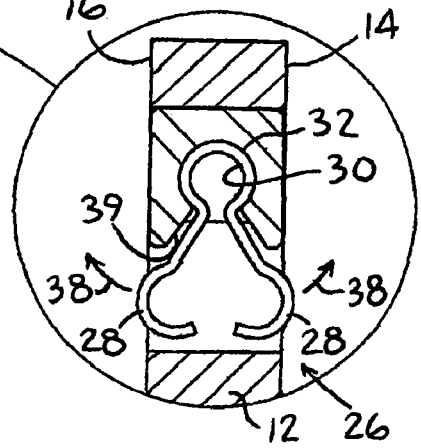
FIG. 3B
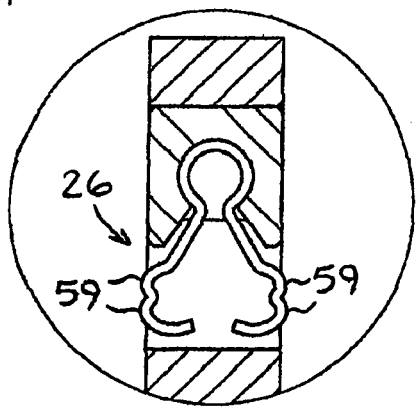

KEY COMBINATION ELEMENT IN KEY BLANK AND KEY

FIELD OF THE INVENTION

The present invention relates to locking apparatus generally and more particularly to a key combination element movably disposed in a key blank or key, and to locks actuated thereby.

BACKGROUND OF THE INVENTION

As is well known in the art, cylinder locks generally include a plug (also called tumbler) arranged for rotation in a lock cylinder housing. Plug pins are slidingly disposed in the plug and are arranged to move against driver pins, which are disposed in bores formed in the cylinder housing and are spring biased toward the axis of the plug rotation. Insertion of a properly cut key in a keyway provided in the plug moves the plug pins against the driver pins and aligns all the pins along a shear line defined by the plug outer circumference, thereby permitting rotation of the plug to cause operation of a latch or locking mechanism.

Cylinders locks are also known that are equipped with a movable element (e.g., pin) disposed in the key blade. An auxiliary locking pin is spring-loaded in the cylinder housing. Upon insertion of the key in the keyway, the movable element aligns with the auxiliary locking pin and interacts therewith to align with the shear line and permit rotation of the plug. Even if a would-be thief were to pick the key-cut combination of the key, he still would not defeat the lock without additionally aligning the movable element with the auxiliary locking pin. The latter action is very difficult without an authorized key, and thus the lock provides high security. Such locks are described, for example, in U.S. Pat. Nos. 5,520,035, 5,784,910 and 5,839,308 to Eizen et al., assigned to the assignee of the present application. These patents describe a key blank that includes a generally elongate shaft portion defining a key combination surface adapted to have formed thereon key cuts which define a key combination. The key blank includes a movable pin element retained within the elongate shaft portion. The movable pin element may be displaced in a single direction, outwardly from the key combination surface.

SUMMARY OF THE INVENTION

The present invention seeks to provide an improved key blank, key and lock, as is described more in detail hereinbelow.

There is thus provided in accordance with an embodiment of the present invention a key blank including a generally elongate shaft portion defining first and second generally flat oppositely directed side surfaces, joined by edge surfaces, at least one of the first and second side surfaces cuttable to form key cuts that define a key combination surface, and at least one key combination element (e.g., a spring) movably disposed in the elongate shaft portion and adapted for touching a lock combination element disposed in a cylinder lock plug, wherein the at least one key combination element has inherent energy for applying an urging force against the lock combination element. The at least one key combination element may be capable of resiliently protruding outwards beyond both the first and second side surfaces The key blank (and/or key made therefrom, and lock provided therefore) may include one or more of the following features. For example, the at least one key combination element may be pivotable about a pivot axis. The at least one key combination element may include a resilient arm disposed in a recess formed in the elongate shaft portion and capable of resiliently protruding outwards from the recess beyond at least one of the first and second side surfaces. For example, the at least one key combination element may include a pair of resilient arms extending from a common base which is pivotally mounted in an arcuate cutout extending from the recess, wherein the recess is formed with grooves radially emanating from the arcuate cutout, and wherein walls of the grooves define limits of angular motion of the resilient arms.

The at least one key combination element may include a plurality of interface surfaces for urging one or more lock combination elements.

BRIEF DESCRIPTION OF THE DRAWINGS

The present invention will be understood and appreciated more fully from the following detailed description, taken in conjunction with the drawings in which:

FIGS. 1 and 2 are respective planar and sectional illustrations of a key blank with key cuts formed thereon to form a key, and including a key combination element movably disposed therein, constructed and operative in accordance with an embodiment of the present invention, FIG. 2 being taken along lines A-A in FIG. 1, wherein the key combination element is in a first position not protruding from the key (key blank);

FIG. 3A is a more detailed sectional illustration of the key combination element shown in FIG. 2, as indicated by the circle;

FIG. 3B is a detailed sectional illustration of a key combination element that has a plurality of interface surfaces for urging a plurality of lock combination elements, in accordance with an embodiment of the present invention;

DETAILED DESCRIPTION OF EMBODIMENTS

Figure 4:
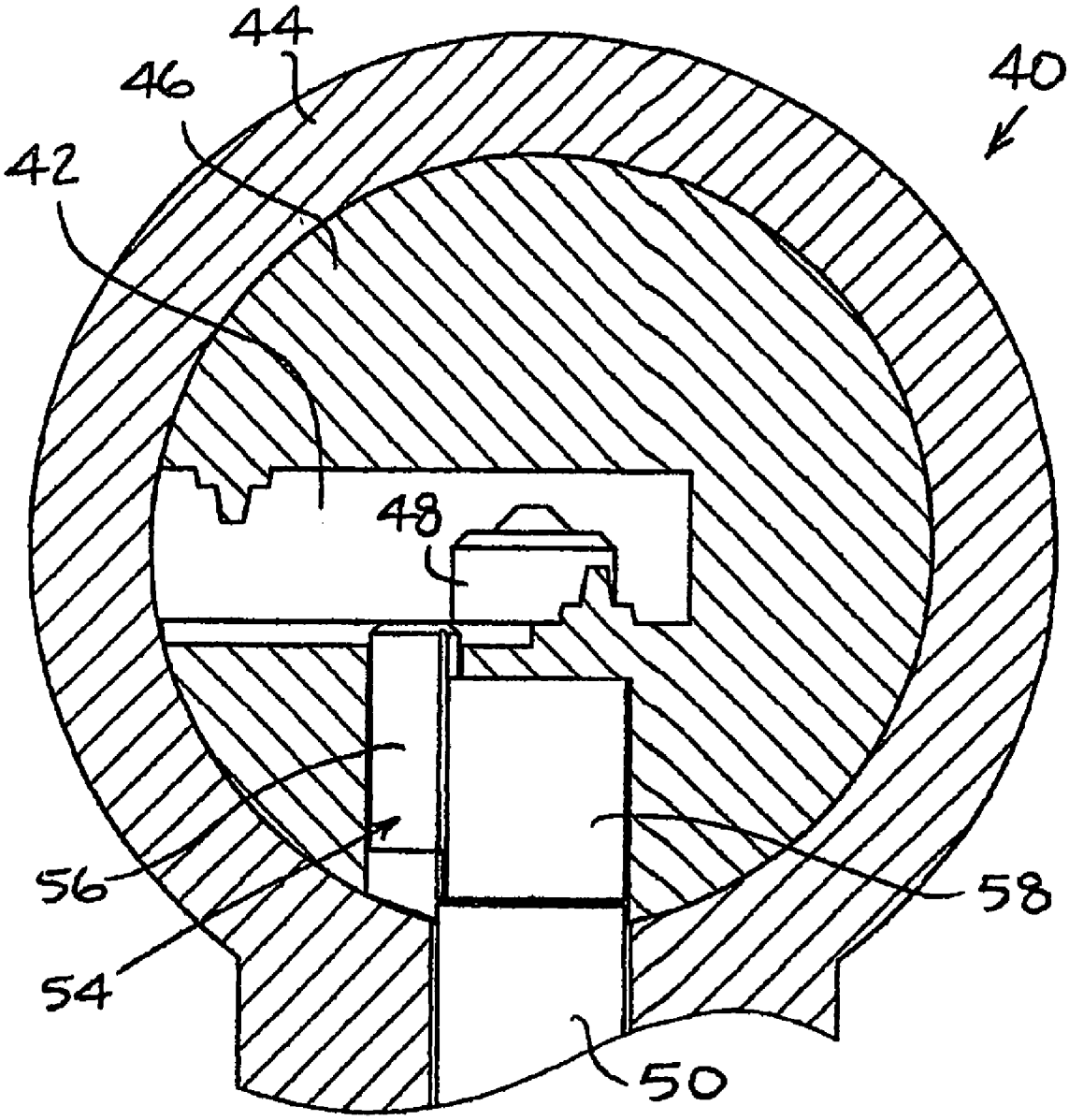
FIG. 4 is a transverse sectional illustration of a cylinder lock, constructed and operative in accordance with an embodiment of the present invention, wherein lock elements of the cylinder lock have not yet been aligned along a shear line.

Reference is now made to FIGS. 1 and 2, which illustrate a key blank 10 constructed and operative in accordance with an embodiment of the present invention. Key blank 10 may have a generally elongate shaft portion 12 extending along a longitudinal axis 13 and defining first and second generally flat oppositely directed side surfaces 14 and 16, joined by edge surfaces 18. Either one or both of first and second side surfaces 14 and 16 may have key cuts 20 formed thereon that define a key combination surface, thereby forming a key 22. The key cuts 20 may be cut for interfacing any kind of lock pins, such as telescoping lock pins, as is well known in the art. The key blank 10 (which became key 22) may have a key head 24.

The key 22/key blank 10 (herein simply "key 22") may define a reversible key, wherein both planar surfaces 14 and 16 constitute key combination surfaces.

In accordance with an embodiment of the present invention, one or more key combination elements 26 are movably disposed in key 22. By "key combination" it is meant that key combination element 26 is capable of touching a lock combination element disposed in a cylinder lock tumbler to bring about alignment with a shear line, as is described hereinbelow.

Different oppositely-directed key combination elements 26 might have different configurations. In such a case, depending on the orientation of the key 22, it is possible to operate two different and mutually exclusive master key systems, each of which is operated by a different pin element configuration. More than one key combination element 26 may be provided on key 22.

Reference is additionally made to FIG. 3A. Key combination element 26 may include one or more resilient arms 28, for example, made of spring metal. In the non-limiting illustrated embodiment, key combination element 26 includes a pair of resilient arms 28 extending from a common arcuate base 30, which is pivotally mounted in an arcuate cutout 32 extending from a recess 34 formed in elongate shaft portion 12. Recess 34 may be an aperture that extends through the thickness of the key 22. Key combination element 26 is capable of resiliently protruding outwards from the recess 34 beyond one or both of first and second side surfaces 14 and 16. In the non-limiting embodiment illustrated in FIG. 3A, key combination element 26 resiliently protrudes outwards beyond both first and second side surfaces 14 and 16.

Key combination element 26 has inherent potential energy or inherent energy for short, meaning that it has innate material properties for storing potential energy for applying an urging force against a lock combination element, as is described further below. In other words, the key combination element 26 is itself a biasing element operative to apply an urging force against the lock combination element. The key combination element 26 may apply the urging force against the lock combination element without help from any other force (such as from some spring) being applied to key combination element 26.

As mentioned previously, key combination element 26 is movably disposed in key 22. In the non-limiting illustrated embodiment, key combination element 26 is pivotable about a pivot axis 36 (the pivoting motion being indicated by arrows 38 in FIG. 3A). Pivot axis 36 (seen in FIG. 1, and perpendicular to the drawing sheet in FIG. 3A) is generally transverse to longitudinal axis 13 of shaft portion 12 and lies in a plane between first and second side surfaces 14 and 16. The plane of pivot axis 36 may be generally parallel to first and/or second side surfaces 14 and 16. Recess 34 may be formed with grooves 39 radially emanating from arcuate cutout 32, wherein the walls of grooves 39 define the limits of angular motion of resilient arms 28.

Reference is now made to FIG. 3B. In this non-limiting embodiment, the key combination element 26 may have a plurality of interface surfaces 59 that can contact and urge one or more lock combination elements. This may increase the number of key/lock combinations possible with the invention.

Figure 5:
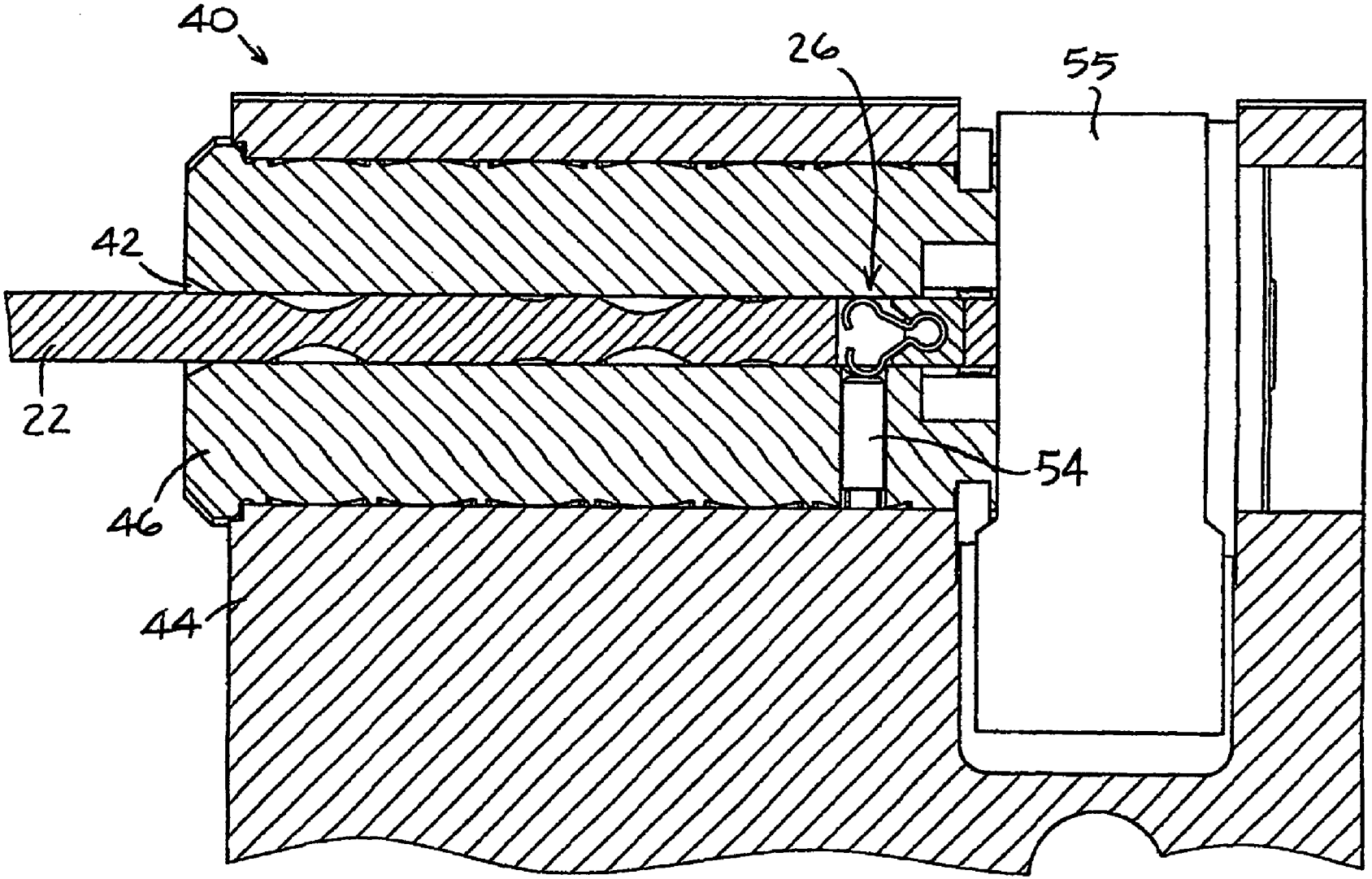
FIGS. 5 and 6 are respective longitudinal and transverse sectional illustrations of the cylinder lock of FIG. 4 with the key of FIG. 1 inserted in a keyway thereof, showing the orientation of the key combination element when the lock elements of the cylinder lock are aligned along the shear line, in accordance with an embodiment of the present invention.
Figure 6:
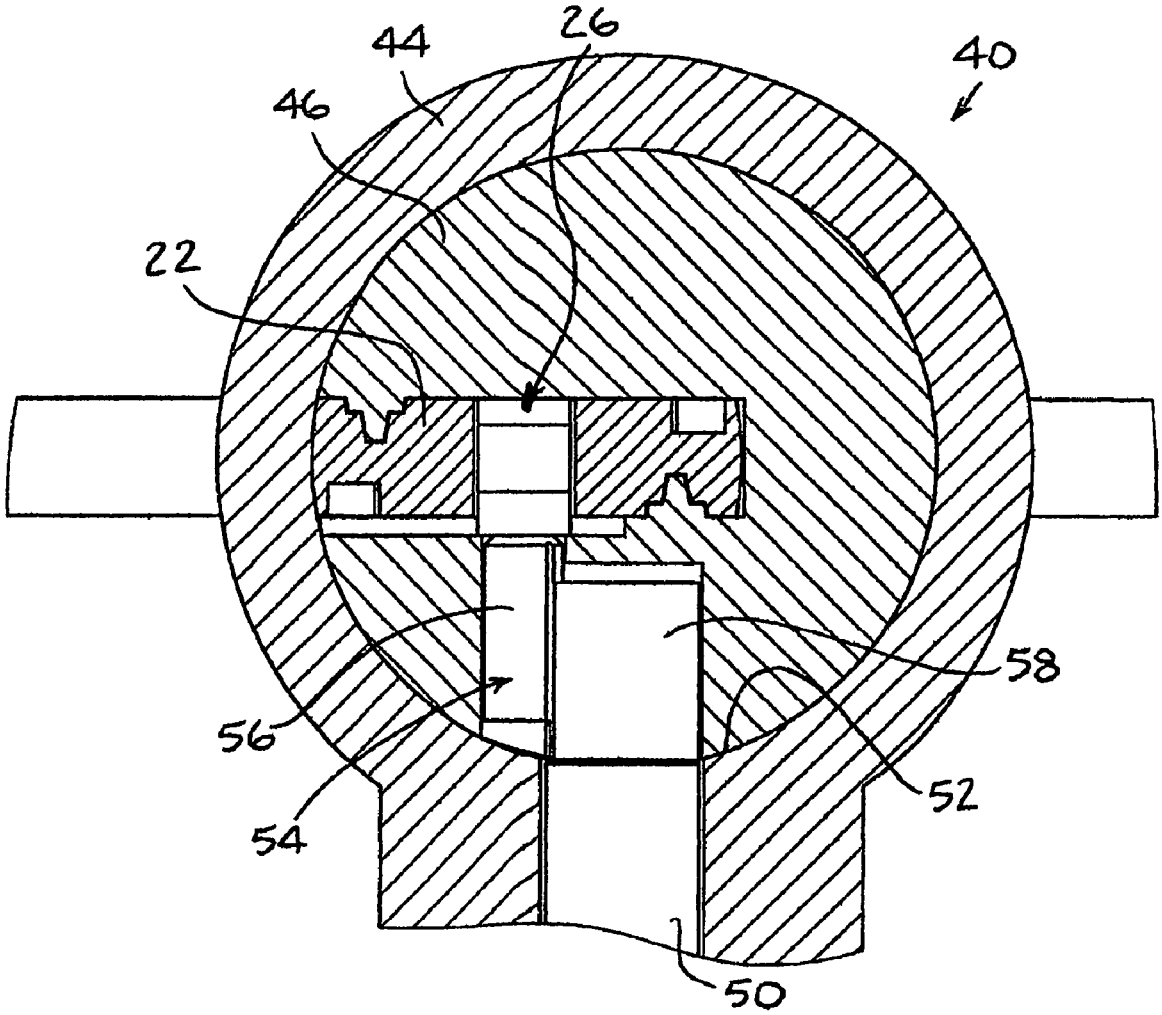

Reference is now made to FIGS. 4-6, which illustrate a cylinder lock 40, constructed and operative in accordance with an embodiment of the present invention. Cylinder lock 40 may comprise a cylinder lock housing 44 and a plug 46, which is arranged for rotation in housing 44 and has a keyway 42.

Cylinder lock 40 may comprise elements common in any conventional cylinder lock. Briefly, as is well known in the art, plug pins 48 (FIG. 4) may be slidingly disposed in plug 46 and arranged to move against driver pins 50, which are disposed in bores formed in the cylinder lock housing 44 and may be spring biased, e.g., toward the axis of the plug rotation. Insertion of key 22 in keyway 42 moves the plug pins 48 against the driver pins 50 and aligns all the pins along a shear line 52 (FIG. 6) defined by the plug outer circumference, thereby permitting rotation of the plug 46 to cause operation of a locking mechanism 55, e.g., a cam (FIG. 5).

In the present invention, the key combination element 26 is adapted for touching a lock combination element 54 disposed in plug 46. Lock combination element 54 may have any configuration, size and shape. In the non-limiting illustrated embodiment, lock combination element 54 comprises a first portion 56 that touches the key combination element 26 and a second portion 58 that touches one of the driver pins 50. Just as more than one key combination element 26 may be provided on key 22, more than one corresponding lock combination elements 54 may be provided in plug 46.

FIGS. 5 and 6 illustrate the key 22 inserted in keyway 42, wherein the key combination element 26 pushes the lock combination element 54 against one of the driver pins 50, and causes alignment along the shear line 52. In this orientation, the key combination element 26 protrudes from the key 22. As mentioned above, the key combination element 26 resiliently protrudes outwards beyond either one of or both first and second side surfaces 14 and 16. Which of the side surfaces 14 and 16 that the key combination element 26 protrudes from is automatically determined by the position of the lock combination element 54. It is noted that as the key 22 moves linearly through keyway 42, the key combination element 26 moves radially as it pivots about pivot axis 36.

The scope of the present invention includes both combinations and subcombinations of the features described hereinabove as well as modifications and variations thereof which would occur to a person of skill in the art upon reading the foregoing description and which are not in the prior art.

What is claimed is:

1. A key blank comprising:

a generally elongate shaft portion defining first and second generally flat oppositely directed side surfaces, joined by edge surfaces, at least one of said first and second side surfaces cuttable to form key cuts that define a key combination surface;

characterized by at least one key combination element pivotally disposed in the elongate shaft portion and adapted for touching a lock combination element disposed in a cylinder lock plug, wherein said at least one key combination element has inherent energy for applying an urging force against the lock combination element, and wherein said at least one key combination element comprises resilient arms disposed in a recess formed in said elongate shaft portion and capable of resiliently protruding outwards from the recess beyond both of said first and second side surfaces before entering the cylinder lock plug.

2. A key blank comprising:

a generally elongate shaft portion defining first and second generally flat oppositely directed side surfaces, joined by edge surfaces, at least one of said first and second side surfaces cuttable to form key cuts that define a key combination surface;

characterized by at least one key combination element having resilient arms pivotable about a pivot axis and movably disposed in the elongate shaft portion and adapted for touching a lock combination element disposed in a cylinder lock plug, said at least one key combination element capable of resiliently protruding outwards beyond both of said first and second side surfaces before entering the cylinder lock plug, and having inherent energy for applying an urging force against the lock combination element, wherein the urging force of said at least one key combination element against the lock combination element is greater than a spring force of the lock combination element against said at least one key combination element.

3. The key blank according to claim 1, wherein said at least one key combination element comprises a plurality of interface surfaces for urging at least one lock combination element.

4. The key blank according to claim 1, wherein said at least one key combination element comprises a pair of resilient arms extending from a common base which is pivotally mounted in an arcuate cutout extending from said recess, and wherein said recess is formed with grooves radially emanating from the arcuate cutout, wherein walls of said grooves define limits of angular motion of said resilient arms.

5. A key comprising:

a generally elongate shaft portion defining first and second generally flat oppositely directed side surfaces, joined by edge surfaces, at least one of said first and second side surfaces being formed with key cuts that define a key combination surface;

characterized by at least one key combination element movably disposed in the elongate shaft portion and adapted for touching a lock combination element disposed in a cylinder lock plug, wherein said at least one key combination element has inherent energy for applying an urging force against the lock combination element, and wherein said at least one key combination element comprises resilient arms disposed in a recess formed in said elongate shaft portion and capable of resiliently protruding outwards from the recess beyond both of said first and second side surfaces before entering in the cylinder lock plug.

6. A key comprising:

a generally elongate shaft portion defining first and second generally flat oppositely directed side surfaces, joined by edge surfaces, at least one of said first and second side surfaces being formed with key cuts that define a key combination surface;

characterized by at least one key combination element having resilient arms pivotable about a pivot axis and movably disposed in the elongate shaft portion and adapted for touching a lock combination element disposed in a cylinder lock plug, said at least one key combination element capable of resiliently protruding outwards beyond both of said first and second side surfaces before entering the cylinder lock plug, and having inherent energy for applying an urging force against the lock combination element, wherein the urging force of said at least one key combination element against the lock combination element is greater than a spring force of the lock combination element against said at least one key combination element.

7. The key according to claim 5, wherein said at least one key combination element comprises a plurality of interface surfaces for urging at least one lock combination element.

8. The key according to claim 5, wherein said at least one key combination element comprises a pair of resilient arms extending from a common base which is pivotally mounted in an arcuate cutout extending from said recess, and wherein said recess is formed with grooves radially emanating from the arcuate cutout, wherein walls of said grooves define limits of angular motion of said resilient arms.

* * * * *